United States Patent [19]

Fujita et al.

[11] 4,436,560

[45] Mar. 13, 1984

[54] PROCESS FOR MANUFACTURING BORIDE DISPERSION COPPER ALLOYS

[75] Inventors: Hironori Fujita; Tohru Arai; Jiro Mizuno; Osami Kasuya; Koichi Ono; Tashio Suzuki, all of Aichi, Japan

[73] Assignees: Kabushiki Kaisha Toyota Chuo Kenkyusho; Kabushiki Kaisha Tokai Rika Denki Seisakusho, all of Japan

[21] Appl. No.: 387,455

[22] Filed: Jun. 11, 1982

[30] Foreign Application Priority Data

Jan. 25, 1982 [JP] Japan ..... 57-9731

[51] Int. Cl.[3] ..... C23F 7/00

[52] U.S. Cl. ..... 148/6; 148/6.11; 204/37 R; 204/48; 427/431

[58] Field of Search ..... 148/6.11, 6.31, 6; 204/37 R, 48; 427/431

Continuation of Ser. No. 261,162, filed as PCT GB80/00139, Sep. 8, 1980, Published as W081/00711, Mar. 19, 1981, § 102(e) date Apr. 30, 1981, Pat. No. 4,363,650.

[56] References Cited

U.S. PATENT DOCUMENTS

| | | | |
|---|---|---|---|
| 2,196,002 | 4/1940 | Whitney et al. | 204/37 R |
| 2,955,959 | 10/1960 | Du Rose | 204/37 R |
| 3,352,667 | 11/1967 | Das et al. | 148/6 B |
| 3,634,145 | 1/1972 | Homan | 148/6.11 |
| 4,011,107 | 3/1977 | Hayes | 148/6 B |

*Primary Examiner*—Michael R. Lusignan
*Assistant Examiner*—Janyce A. Bell
*Attorney, Agent, or Firm*—Berman, Aisenberg & Platt

[57] ABSTRACT

A process for manufacturing a boride dispersed copper alloy by preparing a metallic material having a surface portion comprising at least one of Al, As, Cd, Co, Cr, Fe, Mg, Mo, Nb, Pt, Ta, W and Zr, and copper or an alloy thereof, and diffusing boron into the surface portion. The resulting material includes fine boride particles uniformly dispersed in the surface portion and is useful as a material for electrical contacts or sliding parts due to its high wear, adhesion and arc resistance and high electrical conductivity.

15 Claims, 3 Drawing Figures

PROCESS FOR MANUFACTURING BORIDE DISPERSION COPPER ALLOYS

BACKGROUND OF THE INVENTION

1. Field of the Invention

This invention relates to a process for manufacturing copper alloys having a surface portion in which a boride is dispersed, and which are used for making electrical contacts, sliding parts, and the like.

2. Description of the Prior Art

Electrical contacts have hitherto been made mainly of silver or an alloy thereof, and sliding contacts of tough pitch copper or brass. Silver, which is a noble metal, is not easily available for economical reasons. Tough pitch copper and brass are disadvantageously liable to wear. In order to improve these drawbacks, it has been proposed to make a composite material by dispersing boride particles in a copper matrix, since a boride is highly resistant to wear, adhesion and arc.

A composite material has hitherto been formed from a boride and copper by sintering or melting. According to the former method, a fine boride powder and a copper powder are mixed appropriately, and sintered at an appropriate temperature in an appropriate gas atmosphere. This method, however, involves a lot of difficulty in dispersing a boride uniformly, and requires a high cost of production. According to the latter method, a mixture of copper and a boride is melted by heating at a high temperature, and the molten mixture is cooled and solidified. When the molten alloy is solidified, however, boride crystals are precipitated, and form too large particles to be divided satisfactorily finely even by forging. The materials produced by these methods are low in electrical conductivity, since it is impossible to diffuse a boride only in the surface portion of the metallic material. When making an electrical contact, or sliding part, it is sufficient to impart wear, adhesion and arc resistance to only the surface layer of the contact or sliding area; the interior of the matrix may be composed of any metallic material suiting the intended purpose, including copper which is most commonly used because of its high conductivity.

SUMMARY OF THE INVENTION

It is, accordingly, an object of this invention to provide a process for manufacturing a boride dispersed copper alloy which is completely different from the conventional methods and which is characterized by the formation of a layer of fine boride particles uniformly dispersed in the surface portion of the alloy.

It is another object of this invention to provide a process for manufacturing a material for electrical contacts, sliding parts or the like having high wear, adhesion and arc resistance.

It is still another object of this invention to provide a material having high electrical and thermal conductivity by dispersing fine boride particles only in a surface portion of the material.

It is a further object of this invention to provide the aforementioned process with ease and at a low cost.

The process of this invention for manufacturing a boride dispersed copper alloy comprises the steps of preparing a metallic material having a surface portion comprising an alloy or fine particles of at least one metal (preferably in the amount of 0.5 to 40 atom %) selected from the group consisting of aluminum (Al), arsenic (As), cadmium (Cd), cobalt (Co), chromium (Cr), iron (Fe), magnesium (Mg), molybdenum (Mo), niobium (Nb), platinum (Pt), tantalum (ta), tungsten (W) and zirconium (Zr), and copper or an alloy thereof (preferably in the amount of 60 to 99.5 atom %); and diffusing boron in the metallic material to effect uniform dispersion of fine particles of a boride of at least one metal selected from the group consisting of Al, As, Cd, Co, Cr, Fe, Mg, Mo, Nb, Pt, Ta, W and Zr in the surface portion of the metallic material. (Throughout this specification, % means atom % unless otherwise noted.)

The process of this invention produces a boride dispersed copper alloy of which only the surface portion (preferably to a depth of 0.01 to 1 mm from the surface) contains a boride having an average particle diameter of 0.1 to 20 microns, uniformly dispersed in copper or an alloy thereof.

The alloy produced by the process of this invention is superior in electrical and thermal conductivity, since it comprises a metal matrix, and its surface portion comprises a matrix formed from copper or an alloy thereof. The fine boride particles uniformly dispersed in the surface portion make it possible to obtain an electrical contact or sliding part having high wear, adhesion and arc resistance.

DETAILED DESCRIPTION OF THE INVENTION

Figure 1:
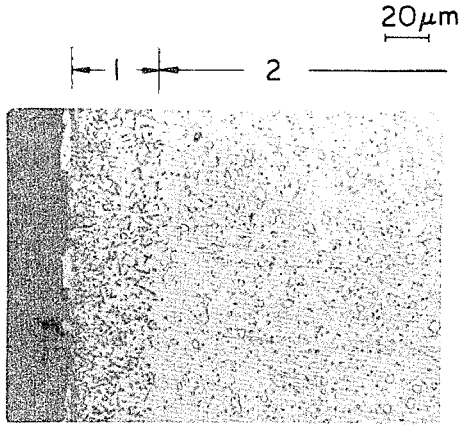
FIG. 1 is a microphotograph showing the structure in cross section of a boride dispersed copper alloy having a matrix composed of a copper alloy containing 5% by weight of chromium.

The process of this invention employs a metallic material having a surface portion (preferably having a depth of 0.01 to 1 mm) comprising at least one metal (preferably in the amount of 0.5 to 40%) selected from the group consisting of Al, As, Cd, Co, Cr, Fe, Mg, Mo, Nb, Pt, Ta, W and Zr, and copper or an alloy thereof. Thus, a boride is formed only in its surface portion. The rest of the material does not participate directly in the formation of a boride, but may be composed of any metal depending on the purpose for which the alloy of this invention is used.

At least one of Al, As, Cd, Co, Cr, Fe, Mg, Mo, Nb, Pt, Ta, W and Zr is employed to form the surface portion, since any of these metals can form a solid solution with, or be dispersed in copper or an alloy thereof, and combine with boron (B) diffused through the surface of the metallic material to form fine boride particles dispersed therein. The boride thus formed of any such metal as hereinabove listed has a relatively high degree of hardness, a low resistivity and a high melting point which are required of a material for making electrical contacts or sliding parts. TABLE 1 compares the physical properties of borides with the materials used conventionally for making contacts. It will be noted therefrom that all of these borides having a resistivity of 20 to $100\times10^{-6}$ Ωcm, a melting point of 1,270° C. to 3,040° C. and a hardness of Hv 1,500 to 3,000 are superior to the conventional materials in melting points and hardness.

As the boride is dispersed only in the surface portion, the resistivity of the contact material as a whole can be kept low enough. Although some of the boride forming metals hereinabove listed can only slightly form a solid solution with copper, it is possible to incorporate any of them in a quantity required to form a boride, and form a sufficiently large quantity of boride, if any such metal is employed in the form of fine particles existing in copper.

The boride forming metal should preferably be employed in the quantity of 0.5 to 40%. If its quantity is less than 0.5%, there is formed only a small quantity of boride to reduce the intended effect. If, on the other hand, its quantity exceeds 40%, there is formed a large quantity of boride. Too large a quantity of boride will prevent good mixing between copper and the boride, reduce electrical and thermal conductivity, and cause the coated layer to crack or peel off.

TABLE 1

| Boride | Resistivity ($\times 10^{-6}$ Ω cm) | Melting Point(°C.) | Hardness(Hv) |
|---|---|---|---|
| $CrB_2$ | 21 | 1,850 | 2,100 |
| $MoB_2$ | 45 | 2,000 | 2,300 |
| NbB | 64 | 2,900 | 2,700 |
| $TaB_2$ | 68 | 3,100 | 2,000 |
| $W_2B_5$ | 21 | 2,800 | 3,000 |
| $ZrB_2$ | 94 | 3,040 | 2,050 |
| $AlB_2$ | — | 1,350 | 2,000 |
| $Co_2B$ | — | 1,265 | 1,500 |
| CoB | — | 1,400 | 2,000 |
| FeB | — | 1,390 | 1,800 |
| $Fe_2B$ | — | 1,550 | 1,500 |
| For Comparison | | | |
| Ag | 1.63 | 960 | 50 |
| Cu | 1.69 | 1,083 | 70 |
| Phosphor bronze | 14 to 19 | 1,050 to 1,070 | 180 |

The surface portion in which the boride is dispersed has preferably a depth of 0.01 to 1 mm (and most preferably 0.03 to 0.2 mm) to provide a surface having high wear, adhesion and arc resistance required for a contact material, while maintaining high electrical and thermal conductivity and high strength in the interior of the underlying matrix. The dispersion of a boride in the whole interior of the copper matrix is not always advisable to ensure the high electrical and thermal conductivity and high strength required of the matrix. Accordingly, it is advisable to disperse the boride only in the surface portion, while employing copper of higher purity for the matrix under the surface portion or adding a reinforcing element thereto, depending on the properties required.

The diffusion of boron is likely to form a nonuniform boride layer instead of a layer in which fine boride particles are dispersed, depending on the composition of the copper alloy in the surface portion. In such a case, it is advisable to reduce the amount of the boride forming metal in the copper alloy, or incorporate another element into the copper matrix to ensure dispersion of the boride. In order to form cobalt boride, for example, it is advisable for the surface portion of the metallic material to comprise a cobalt-copper alloy containing 0.5 to 40% of cobalt, the balance being copper. An increase in the amount of cobalt is, however, likely to result in the formation of undesirably large cobalt boride particles, or segregation of cobalt boride along the crystals of the cobalt-copper alloy. In such a case, it is effective to incorporate at least one of manganese, titanium, silicon and chromium into the cobalt-copper alloy in order to promote the formation of fine cobalt boride particles, and prevent the segregation of cobalt boride. The preferred quantity of any such metal incorporated into the cobalt-copper alloy is in the range of, say, 0.1 to 3%.

The metallic material may be composed of a copper alloy as a whole, including its surface portion. For this purpose, a mixture of metals is melted to form an alloy.

A metallic material of which only the surface portion is composed of a copper alloy can typically be prepared by coating Co, Al, As, Cd or the like on the surface of a copper matrix, and heating the coated metal to diffuse it into copper. Cobalt or the like may be coated on the copper surface by a known method, such as electroplating, chemical plating, vacuum evaporation, sputtering or spray coating. The diffusion of cobalt or the like into the matrix is accomplished by the thermal diffusion of the metal at a high temperature. Manganese, titanium, silicon, chromium or like metal employed to form fine boride particles can be incorporated into copper beforehand, or can alternatively be incorporated, and diffused when diffusing cobalt, or the like.

The metallic material may be in the form of a sheet, rod or cottony mass, or of any other form that suits the purpose for which the product of this invention will be used.

Any known boriding method can be employed to diffuse boron in the surface of the metallic material to form a layer of fine boride particles dispersed in its surface portion. Typical examples of the boriding methods include a molten salt method which comprises immersing the metallic material in a molten bath containing dissolved boron, a powder method which comprises burying the metallic material in a mixed powder of, for example, boron carbide, and boron fluoride or ammonium chloride, and heating it, and a physical vapor deposition method which comprises evaporatng boron on the metallic material in a vacuum atmosphere. The boron diffused in the metallic material combines with cobalt or the like in the copper alloy to form a boride. The boride thus obtained is $AlB_2$, $AlB_{10}$, AsB, $AsB_6$, $CdB_6$, $Co_2B$, CoB, CrB, $CrB_2$, FeB, $Fe_2B$, $MgB_2$, $MgB_4$, $MoB_2$, $Mo_2B$, NbB, $NbB_2$, PtB, $Pt_2B_3$, TaB, $TaB_2$, $W_2B_5$, $ZrB_2$, or the like, or a mixture thereof.

A layer in which boride particles are dispersed is, thus, formed in copper or an alloy thereof. The smaller the boride particles, the better. Accordingly to the process of this invention, it is possible to obtain a boride having an average particle diameter of 0.1 to 20 microns. It is preferable that the boride particles occupy about 1 to 50% by volume of the surface portion. The thickness of the boride layer in the surface portion is preferably in the range of 0.01 to 1 mm (most preferably 0.03 to 0.2 mm). A layer having a greater thickness can be formed if the diffusion of boron is continued for a longer time, or if the heating temperature is raised.

According to the process of this invention as hereinabove described, it is easy to disperse fine boride particles uniformly in only the surface portion of the metallic material. The boride has a higher degree of hardness, a higher melting point, a higher decomposition point and a higher degree of chemical stability than any known contact material. Accordingly, the metallic material produced by dispersing a boride in only its surface portion in accordance with the process of this invention has a surface portion having superior wear, adhesion and arc resistance, and is useful for making electrical contacts and sliding parts having excellent properties. According to this invention, it is further possible to ensure a sufficiently high electrical conductivity for an electrical contact material, since the boride has a relatively high electrical conductivity, and is dispersed in only the surface portion. The boride dispersed copper alloy made by the process of this invention is easy to bend, pierce or coin, since its matrix composition can be selected substantially as desired. The matrix composition can be selected so as to ensure a high level of thermal conductivity.

The invention will now be described with reference to several embodiments thereof.

EMBODIMENT 1

Ninety-five parts by weight of copper and five parts by weight of chromium were melted to form a chromium-copper alloy consisting of 94.0% of copper and 6.0% of chromium. A columnar specimen having a diameter of 6.4 mm and a length of 24 mm was prepared from the alloy by forging. The specimen was immersed in a molten salt bath composed of 60 parts by weight of borax, and 40 parts by weight of boron carbide ($B_4C$) powder having a particle diameter of 79 to 149 microns, and having a temperature of 950° C., and removed therefrom after four hours, whereby a boride dispersed copper alloy was obtained.

The specimen was, then, examined in cross section by a microscope. A microphotograph thereof appears in FIG. 1, in which the boride dispersed layer is shown at 1, and the chromium-copper alloy matrix at 2. It will be noted therefrom that fine boride particles having a diameter of 0.1 to 1 micron were uniformly dispersed along a depth of about 40 microns. The boride occupied 6% by volume of the surface portion. It was found by X-ray diffraction to be CrB. The coarse particles in the matrix were of chromium which had not formed a solid solution with copper.

EMBODIMENT 2

The procedures of EMBODIMENT 1 were repeated to prepare a chromium-copper alloy specimen. It was buried in a powder mixture composed of 90 parts by weight of ferroboron containing 20% by weight of boron and having a particle diameter of about 60 to 149 microns, and 10 parts by weight of potassium borofluoride ($KBF_4$) powder having a particle diameter of about 90 microns, and heated at 950° C. for four hours. Its structure and composition were examined as in EMBODIMENT 1. A uniform dispersion of fine CrB particles in the surface portion was ascertained.

EMBODIMENT 3

Figure 2:
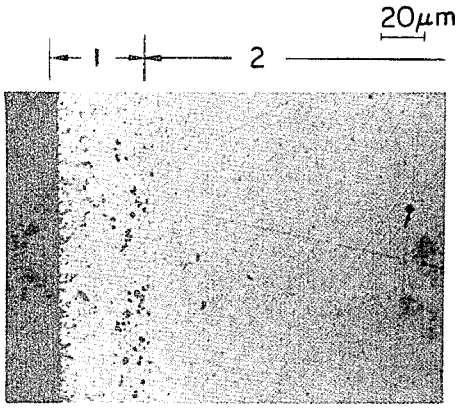
FIG. 2 is a similar microphotograph showing a boride dispersed copper alloy having a matrix composed of a copper alloy containing 5% by weight of cobalt.

Ninety-five parts by weight of copper and five parts by weight of cobalt were melted to form a cobalt-copper alloy consisting of 94.6% of copper and 5.4% of cobalt. It was immersed for four hours in a molten salt bath having a temperature of 850° C. as in EMBODIMENT 1, whereby a boride dispersed copper alloy was obtained. FIG. 2 is a microphotograph showing a cross section of this specimen. The photograph discloses a dispersed layer of fine CoB particles having a diameter of 0.5 to 2 microns along a depth of about 40 microns. The boride occupied 6% by volume of the surface portion. Cobalt which had not formed a solid solution was found in the matrix.

EMBODIMENT 4

Figure 3:
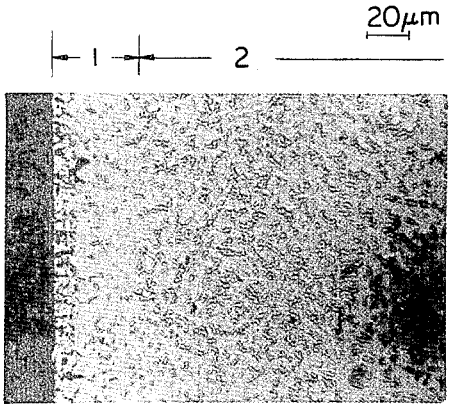
FIG. 3 is a similar microphotograph showing a boride dispersed copper alloy having a matrix composed of a copper alloy containing 3% by weight of zirconium.

Ninety-seven parts by weight of copper and three parts by weight of zirconium were melted to form a zirconium-copper alloy consisting of 97.9% of copper and 2.1% of zirconium. Then, the procedures of EMBODIMENT 3 were repeated. FIG. 3 is a microphotograph showing the specimen obtained in cross section. It will be noted therefrom that a dispersed layer of fine $ZrB_2$ particles having a diameter of 0.5 to 2 microns was formed along a depth of about 35 microns. The boride occupied 4% by volume of the surface portion. Some undissolved $Cu_3Zr$ was found in the matrix.

EMBODIMENT 5

A layer of cobalt having a thickness of about 5 microns was electroplated on pure copper, and they were heated at 1,020° C. for eight hours in an inert atmosphere, whereby cobalt formed a solid solution with copper. The procedures of EMBODIMENT 3 were repeated to diffuse boron (B) to form a boride dispersed copper alloy. A uniformly dispersed layer of fine CoB particles having a depth of about 35 microns was formed on the specimen, substantially as had been the case in EMBODIMENT 3. Virtually no undissolved cobalt was, however, found in the copper matrix, as opposed to the foregoing EMBODIMENTS.

These specimens were tested for suitability as a material for making switching contacts and sliding contacts.

An ASTM tester was used for the former test, and two circular specimens having a diameter of 6.4 mm and a thickness of 2.4 mm were brought into contact with each other, and separated from each other 250,000 times repeatedly at a DC voltage of 12±0.1 V, a current of 10 A, a lamp load of 130 W, a contact load of 300 g, a separation load of 300 g, and a repetition rate of 60 times per minute. The test results are shown in TABLE 2. No adhesion, seizure or other trouble was found.

TABLE 2 also shows the results of similar tests conducted on conventional contact materials for purposes of comparison. COMPARATIVE EXAMPLES 101 to 105 represent silver, a silver-copper alloy containing 10% by weight of copper, a copper-nickel alloy containing 10% by weight of nickel, tough pitch copper, and bronze, respectively. The contact materials produced by the process of this invention did not show any adhesion, transfer, or other inconvenience, but were found superior to any conventional material.

The sliding contact tests were conducted by using a specially prepared tester including a copper plate rotating at a speed of 60 rpm, and having a point 12.5 mm spaced apart from its axis of rotation against which a semispherical specimen was to be pressed. The tests were conducted at a DC voltage of 12±0.1 V, a current of 10 A, a contact load of 300 g and a sliding rate of 78.5 mm per second for a total sliding distance of 62,000 m without using any lubricant. The specimen was a 50 mm square plate having a thickness of 1 mm, and formed with a central semispherical projection having a radius of 5 mm, and defining a sliding surface.

TABLE 2

| | Tests for suitability for switching contacts | | | Tests for suitability for sliding contacts | | |
|---|---|---|---|---|---|---|
| | Contact resistance (mΩ) | Repeated 250,000 times | Others | Contact resistance (mΩ) | Wear | Others |
| EMBODIMENT 1 | 0.8 | Acceptable | Nothing abnormal (little transfer) | 0.7 | Slightly worn | No change |
| EMBODIMENT 3 | 0.5 | " | Nothing abnormal (little transfer) | 0.6 | Slightly worn | No change |
| EMBODIMENT 4 | 0.6 | " | Nothing abnormal (little transfer) | 0.8 | Slightly worn | No change |
| COMPARATIVE EXAMPLE | | | | | | |
| 101 | 0.4 | Acceptable | Heavy transfer | | | |
| 102 | 0.4 | " | Heavy transfer | | | |
| 103 | 2.0 | Adhesion | Heavy oxidation | | | |
| 104 | | | | 2.0–5.0 | Seriously worn | Heavy oxidation |
| 105 | | | | 3.0–6.0 | Seriously worn | " |

It was tested against a 50 mm square tough pitch copper plate having a thickness of 1 mm. The test results are shown in TABLE 2. As is obvious from TABLE 2, the specimens of this invention showed only a very low contact resistance in the range of 0.6 to 1.2 mΩ, and were hardly worn.

While the invention has been described with reference to the several embodiments thereof, it is to be understood that modifications or variations may be easily made by anybody of ordinary skill in the art without departing from the scope of this invention which is defined by the appended claims.

What is claimed is:

1. A process for manufacturing a boride dispersed copper alloy, which comprises:

preparing a metallic material having a surface portion comprising an alloy or fine particles of at least one element selected from the group consisting of aluminum (Al), arsenic (As), cadmium (Cd), cobalt (Co), chromium (Cr), iron (Fe), magnesium (Mg), molybdenum (Mo), niobium (Nb), platinum (Pt), tantalum (Ta), tungsten (W) and zirconium (Zr), and copper or an alloy thereof; and diffusing boron into said metallic material to form in said surface portion thereof fine particles of a boride of at least one element selected from the group consisting of Al, As, Cd, Co, Cr, Fe, Mg, Mo, Nb, Pt, Ta, W and Zr.

2. A process according to claim 1, wherein said metallic material is prepared by coating said at least one element on the surface of copper or an alloy thereof, and heating said coated element to diffuse the same into said surface portion.

3. A process according to claim 1, wherein said surface portion of said metallic material has a depth of from 0.01 to 1 mm.

4. A process according to claim 3, wherein said surface portion of said metallic material has a depth of from 0.03 to 0.2 mm.

5. A process according to claim 1, wherein said surface portion of said metallic material comprises 0.5 to 40 atom % of an alloy or fine particles of said at least one element.

6. A process according to claim 1, wherein said surface portion of said metallic material during the preparing step further comprises at least one of manganese, titanium, silicon and chromium, thereby promoting the formation of fine boride particles during the diffusing step.

7. A process according to claim 6, wherein said at least one of manganese, titanium, silicon and chromium is incorporated in the range of 0.1 to 3 atom %.

8. A process according to claim 1, wherein said boride has an average particle diameter of 0.1 to 20 microns.

9. A process according to claim 1, wherein said boride occupies about 1 to 50% by volume of said surface portion.

10. A process according to claim 1, wherein said boron is diffused by one method selected from the group consisting of a molten salt method, a powder method and a physical vapor deposition method.

11. A process according to claim 1, wherein chromium and copper are melted to prepare said metallic material having the surface portion of a copper-chromium alloy, and said metallic material is immersed in a molten salt bath containing boron to form fine $CrB_2$ particles uniformly dispersed in said surface portion.

12. A process according to claim 1, wherein chromium and copper are melted to prepare said metallic material having the surface portion of a copper-chromium alloy, and said metallic material is buried and heated in a powder mixture containing boron to form fine CrB particles uniformly dispersed in said surface portion.

13. A process according to claim 1, wherein cobalt and copper are melted to prepare said metallic material having the surface portion of a copper-cobalt alloy, and said metallic material is immersed in a molten salt bath containing boron to form fine CoB particles uniformly dispersed in said surface portion.

14. A process according to claim 1, wherein zirconium and copper are melted to prepare said metallic material having the surface portion of a copper-zirconium alloy, and said metallic material is immersed in a molten salt bath containing boron to form fine $ZrB_2$ particles uniformly dispersed in said surface portion.

15. A process according to claim 2, wherein cobalt was electroplated on pure copper and heated to prepare said metallic material having the surface portion of a copper-cobalt alloy, and said metallic material is immersed in a molten salt bath containing boron to form fine CoB particles uniformly dispersed in said surface portion.

* * * * *

UNITED STATES PATENT OFFICE

CERTIFICATE OF CORRECTION

PATENT NO. : 4,436,560

DATED : March 13, 1984

INVENTOR(S) : Hironori Fujita; Tohur Arai; Jiro Mizuno; Osami Kasuya; Koichi Ono; Tashio Suzuki It is certified that error appears in the above-identified patent and that said Letters Patent are hereby corrected as shown below:

Title page, left column, last four lines, delete "Continuation of ... Pat. No. 4,363,650."

Signed and Sealed this

*Second* Day of *July 1985*

[SEAL]

*Attest:*

DONALD J. QUIGG

*Attesting Officer* *Acting Commissioner of Patents and Trademarks*